US005409732A

United States Patent [19]

Leonard et al.

[11] Patent Number: 5,409,732

[45] Date of Patent: Apr. 25, 1995

[54] ROLL GAP CONTROLLER FOR REGULATING COATING THICKNESS

[75] Inventors: William K. Leonard, River Falls, Wis.; Stephen W. Mohn, St. Paul; P. Daniel Schiller, Maplewood, both of Minn.

[73] Assignee: Minnesota Mining and Manufacturing Company, St. Paul, Minn.

[21] Appl. No.: 160,445

[22] Filed: Dec. 1, 1993

Related U.S. Application Data

[62] Division of Ser. No. 861,281, Mar. 31, 1992, abandoned.

[51] Int. Cl.[6] ..... B05D 3/12

[52] U.S. Cl. ..... 427/10; 118/665; 118/119; 118/126; 427/9; 427/359

[58] Field of Search ..... 118/126, 245, 249, 413, 118/414, 419, 665, 688, 692, 712, 118, 119; 427/9, 10, 359, 424, 434.2; 156/360

[56] References Cited

U.S. PATENT DOCUMENTS

| | | | |
|---|---|---|---|
| 3,523,987 | 8/1970 | Camhi | 264/39 |
| 3,843,434 | 10/1974 | Heiks et al. | 156/360 |
| 3,844,870 | 10/1974 | Donoghue et al. | 156/360 |
| 3,940,221 | 2/1976 | Nissel | 425/141 |
| 4,182,259 | 1/1980 | Garner et al. | 118/712 |
| 4,251,566 | 2/1981 | Gingerich | 427/10 |
| 4,305,704 | 12/1981 | Lemelson | 425/296 |
| 4,366,019 | 12/1982 | Jones | 156/360 |
| 4,463,040 | 7/1984 | Kisler | 427/445 |
| 4,594,063 | 6/1986 | Reifenhauser | 425/141 |
| 4,704,296 | 11/1987 | Leanna et al. | 427/10 |
| 4,732,776 | 3/1988 | Boissevain | 427/10 |
| 4,808,445 | 2/1989 | Fujiwada et al. | 118/414 |
| 4,899,687 | 2/1990 | Sommer et al. | 118/126 |
| 4,899,691 | 2/1990 | Fitzgerald | 118/665 |
| 5,081,951 | 1/1992 | Most et al. | 427/9 |
| 5,147,462 | 9/1992 | Wollam | 118/126 |

FOREIGN PATENT DOCUMENTS

| | | | |
|---|---|---|---|
| 2018990 | 2/1991 | Canada . | |
| 070705A3 | 1/1983 | European Pat. Off. | 427/10 |
| 1610968 | 8/1971 | Germany | 118/126 |
| 60-210418A | 10/1985 | Japan . | |
| 2058663A | 4/1981 | United Kingdom | 118/688 |
| 2249234A | 4/1992 | United Kingdom . | |

*Primary Examiner*—Joseph W. Drodge
*Attorney, Agent, or Firm*—Gary L. Griswold; Walter N. Kirn; Eric D. Levinson

[57] ABSTRACT

A method for regulating the thickness of an applied coating. The method includes passing a web through two members which define a gap between them. A sensor measures periodic variations in the thickness of the coating on the web. An automatic controller analyzes information from the sensor and converts the information into gap adjusting signals. Piezoelectric or magnetostrictive translators adjust the size of the gap to compensate for repeating variations in coating thickness.

14 Claims, 2 Drawing Sheets

Fig. 1
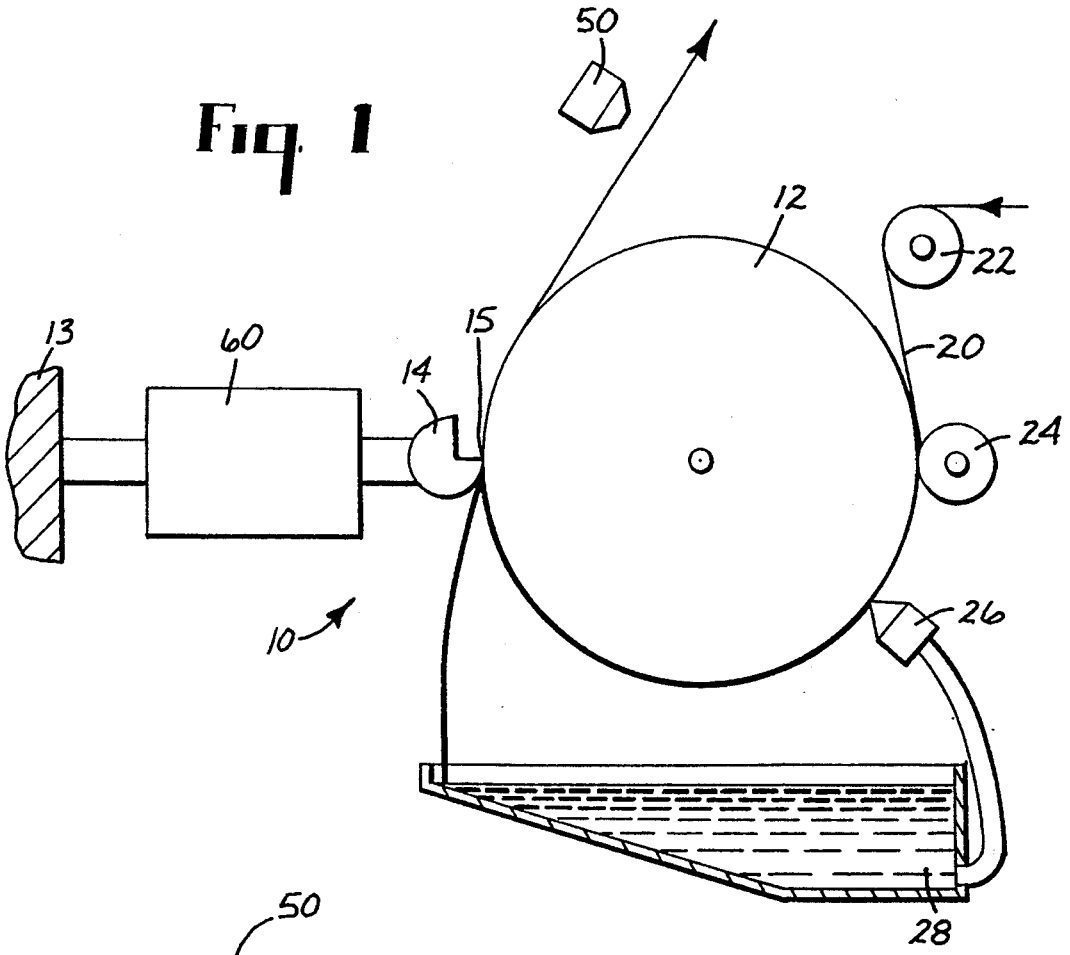
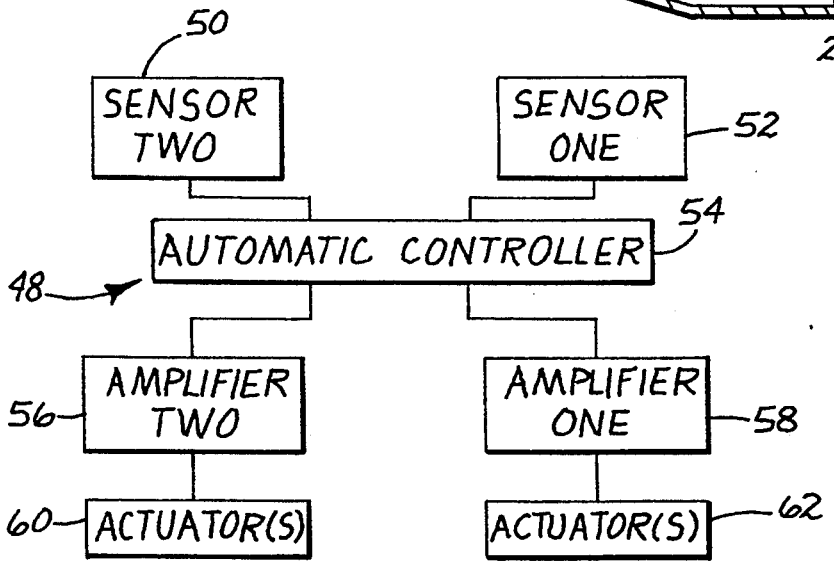
Fig. 2

ROLL GAP CONTROLLER FOR REGULATING COATING THICKNESS

This is a division of application Ser. No. 07/861,281, filed Mar. 31, 1992, abandoned.

FIELD OF THE INVENTION

The present invention relates generally to a device for controlling the size of a gap through which a coating is applied to a web. In particular, the present invention relates to a coating device for regulating the size of the gap to compensate for periodic variations in coating thickness.

BACKGROUND OF THE INVENTION

Coating devices are well known and are widely used to apply layers of materials to webs and also to form the webs themselves. Commonly, coaters employ a roll and a beam, or two rolls to form a gap through which a coating of a prescribed thickness may be produced. Examples of such coaters are roll coaters, knife coaters, and reverse roll coaters. Other coaters employ a slot orifice method wherein coating fluid is dispensed from a coating head in the form of a stream. One such slot orifice coater is a bead-coater, which is commonly used in the photographic industry. Slot orifice coaters use a backup roll to support the web as it travels past the coating head.

Control of the width and shape of the gap between the roll and beam or the two rolls is important to producing useable coatings on both gap coaters and slot orifice coaters. In order to ensure that the thickness and uniformity of the web or coating does not vary beyond certain pre-set parameters, it is desirable to be able to adjust the size and shape of the gap to compensate for variations which may result over time (e.g. changes in viscosity, flow, temperature, and web speed, and wear of the die and the mechanical parts of the device).

Numerous mechanisms are known to adjust the size of the gap between a beam and roll. One common mechanism uses helically threaded bolts which, when rotated, move a wedge placed between the bearing mounting of the roll and a structural extension of the beam. Because a force is applied to hold all three of these members together in physical contact, movement of the wedge changes the spacing between the beam and the roll. Another method employs threaded bolts directly. The bolts are threaded through a structural extension of the beam and their ends bear against the roll bearing mounting. Force is applied to hold the bolt end against the bearing mount. Rotation of the bolt directly changes the spacing between the beam and the roll. Still another method involves having a flexible beam rigidly mounted at only one or a limited number of points or edges, and placing a plurality of bolts which can bear against and apply force to bend the beam so as to effect adjustment of the size of the gap between the roll and the setting edge of the beam.

Traditionally, the size of the gap has been adjusted by manually tightening or loosening the bolts with a wrench. It is also known to use individual heaters to heat the bolts in order to cause the length of the bolts to expand, thus changing the size of the gap.

It is also known to use piezoelectric and magnetostrictive translators to adjust the size of the gap. Typically, a measuring device is located downweb of the coater and sends signals to the piezoelectric translators to adjust the size of the gap. These apparatus are based on the assumption that the thickness of the coating at the location of the measuring device is the same as the thickness of the coating at the gap. While this assumption is generally true for slowly evolving changes, it is not true for more rapid changes in coating thickness-those variations which appear and disappear so quickly that the coating thickness being measured at the sensor does not represent the coating thickness at the gap. Indeed, for rapidly repeating variations in coating thickness, the control system may actually exacerbate the problem. For example, if the downweb distance between the measuring device and the gap is equal to the distance between an area of thinner and thicker coating on the web caused by periodic variations in coating thickness, then the measuring device would be measuring an area of thicker (or thinner) coating, while the area of thinner (thicker) coating was passing through the gap. Accordingly, the measuring device would signal the piezoelectric actuators to decrease (increase) the size of the gap, even though the gap was already too small (large).

Rapidly repeating variations in coating thickness are caused by many phenomena, including periodic variations in the thickness of the web caliper upon which the coating is placed, periodic changes in coating fluid viscosity and roll speed, and most importantly, periodic roll "runout," which refers to irregularities in the rotational path of the surface of the roll. Periodic runout occurs because the rolls are not perfectly round, their bearings are not perfectly made, and their supporting shafts are not perfectly straight. Periodic runout is the same for every revolution of the roll.

While the rolls used in coaters may have a radius of about 2 to 50 cm, imperfections as small as 1 $\mu$m can result in the uneven application of a coating. Because the roll can rotate at 10 or more revolutions per minute, the use of heat adjustable bolts, which have response times on the order of minutes, to regulate gap size to compensate for periodic runout is impractical. Systems for slowly adjusting the gap with motor driven screws are known but they cannot be effectively used to compensate for roll runout because they have limited speed and accuracy of response. Additionally, the backwards and forwards movements of any mechanical mechanism required by the oscillatory nature of runout compensation creates severe wear and maintenance problems.

It would be desirable to have an apparatus capable of applying a coating that is free from the periodic inconsistencies associated with known coating devices, particularly those apparatus which employ one or more rolls. Any such apparatus must be efficient and accurate to be commercially viable.

SUMMARY OF THE INVENTION

The present invention is embodied as a web forming device for regulating the thickness of a web, and a device for regulating the thickness of a coating applied to a web. The device has two members which define a gap between them through which a web can pass. A sensor provides information representative of periodic variations in the thickness of the coating on the web leaving the gap. An automatic controller is coupled to the sensor and analyzes the information representative of the periodic variations in the coated web thickness and converts the information into gap adjusting signals. An actuator means responsive to the signals adjusts the size of the gap to compensate for the periodic variations in coating thickness. In one embodiment, piezoelectric or magnetostrictive translators are used to adjust the size of the gap.

BRIEF DESCRIPTION OF THE DRAWINGS

FIG. 1 is a side view of a single roll gap coating device in accordance with the present invention.

FIG. 2 is a block diagram of the control system in accordance with the present invention for the device shown in FIG. 1.

DETAILED DESCRIPTION OF THE PREFERRED EMBODIMENTS

Figure 3:
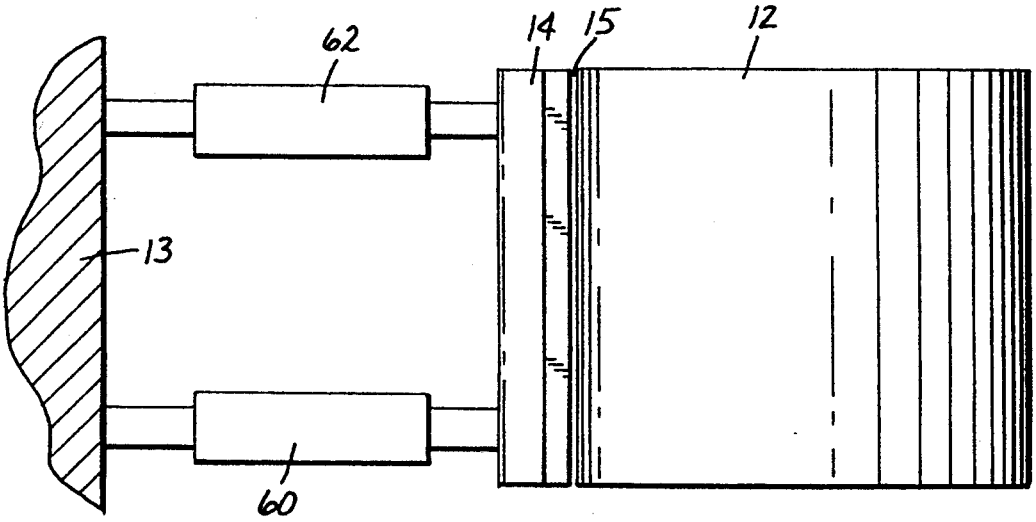
FIG. 3 is a top view of the device shown in FIG. 1.

A single roll gap coater 10 for uniformly coating a web 20 is shown in FIGS. 1 and 3. Single roll gap coater 10 includes a first member, back-up roll 12, which is mounted for clockwise rotation by a motor (not shown) about an axis perpendicular to the plane of FIG. 1. A second member, notched bar metering beam 14, is oriented parallel to the central axis of roll 12, and is separated from roll 12 by a small gap 15. Coating fluid is kept in reservoir 28 and is transported upward by a pump (not shown) to flow bar 26. Examples of typical coating fluids are emulsions, solutions, dispersions, thermoplastics, gels, pastes, reactive polymers, thermally-setting polymers, and radiation-cured oligomers. Actuators 60 and 62 drive metering beam 14 with respect to frame structure 13 to vary the size of gap 15. Web 20 is fed around roller 22 and forced against back-up roll 12 by roller 24. As indicated by the arrows, web 20 follows a path about roll 12 and through gap 15. Coating fluid from reservoir 28 is applied in excess to web 20 by flow-bar 26. The excess fluid is shaved off by metering bar 14 to produce a coating of desired thickness. The excess coating fluid is returned to reservoir 28.

A control system 48 for regulating the size of gap 15 is illustrated generally in FIGS. 1 and 2. As shown, control system 48 includes sensors 50 and 52, automatic controller 54, amplifiers 56 and 58, and actuators 60 and 62. Information representative of the thickness of the coating fluid on web 20 is sensed and provided by thickness monitors such as optical density sensors 50 and 52. Sensors 50 and 52 are positioned to monitor the thickness of the fluid on web 20 at spaced locations along the width of web 20. Signals generated by sensors 50 and 52 are conveyed to automatic controller 54, which processes the thickness signals in accordance with stored programs to generate gap adjusting signals. The range, levels, and other characteristics of the gap adjusting signals are converted to a form appropriate for actuators 60 and 62 by programmable amplifiers 56 and 58. Actuators 60 and 62 independently move beam 14 toward or away from roll 12, in response to the adjusting signals, thereby controlling the width of gap 15. Control system 48 quickly and accurately controls the width of gap 15.

It is important that this cycle of thickness monitoring, automatic controller calculation, amplification, and actuator adjustment occur at a very fast rate so that the cycle may be repeated many times per minute. For example, if roll 12 is rotating at 250 revolutions per minute, it is preferred that the actuators 60 and 62 be capable of adjusting the size of gap 15 at least 500 times per minute (i.e., at twice the rotational frequency), and preferably at a higher rate. This is because for every revolution of roll 12, the actuators 60 and 62 must go through at least one cycle of extension and contraction to compensate for runout. Optimally, the actuators 60 and 62 would go through multiple cycles for every revolution of roll 12, depending upon the exact runout as determined by the sensors. Piezoelectric actuators 60 and 62 are capable of adjusting the gap 15 at this fast rate. In the alternative, magnetostrictive translators may be used as actuators 60 and 62. Actuators of these types are generally known and commercially available.

Piezoelectric actuators 60 and 62 can provide considerable force during expansion only. Therefore, the piezoelectric actuators 60 and 62 should be incorporated into spring loaded housings (not shown) so that the translators are continuously kept in a state of compression. This approach assures that metering beam 14 will be quickly retracted when the piezoelectric actuators 60 and 62 are in retraction. The piezoelectric actuators 60 and 62 should have a suitable travel length to give the metering beam an adequate range of motion for the intended runout application. Useful travel lengths are on the order of 10–100 $\mu$m.

When a coating is applied to web 20 as shown in FIG. 1, a repeating pattern of thinner and thicker coating, corresponding to imperfections in the radial dimensions of roll 12 and the imperfections in the dynamic path of the rotating roll surface, will typically result if metering beam 14 remains in a fixed position. Periodic variations may also result from variations in the downweb caliper, fluid viscosity, roll speed, etc. The periodic variations are sensed by sensors 50 and 52 and may be minimized by moving metering beam 14 at a frequency which matches the frequency of the roll runout defect that results from rotation of the roll 12, as well as the periodic variations in coating thickness caused by any other factors. Automatic controller 54 should be capable of processing the signal patterns from sensors 50 and 52 and regulating actuators 60 and 62 to produce a coating of uniform thickness. To accurately control the width of gap 15, automatic controller 54 takes into account factors such as the relationship between optical density and thickness of the coating, non-linearities and scaling factors associated with the sensors 50 and 52 and actuators 60 and 62, and the phase relationship between the position of sensors 50 and 52 and metering beam 14.

In one embodiment, automatic controller 54 is a microprocessor which is programmed to implement a proportional integral differential (PID) control function. In the alternative, an autoregressive integrated moving average (ARIMA) transfer function, or some other appropriate single or multi-variable closed-loop control algorithm may be used depending upon whether or not actuators 60 and 62 are operating individually or together. Control algorithms of these types are generally known. For example, ARIMA transfer functions are discussed in *Time Series Analysis: Forecasting and Control,* by George E. P. Box and Gwilym M. Jenkins; Holden-Day, Inc., Oakland, Calif., 1976.

Actuators 60 and 62 do not necessarily move in unison because each actuator can be governed by its own sensor—actuator 60 being governed by sensor 50, and actuator 62 by sensor 52. In a simpler version of the invention, actuators 60 and 62 could move in unison in response to identical signals. However, such a system would not be able to regulate the shape of gap 15 as thoroughly as a system using independent actuators. In a more complex arrangement of the present invention (not shown), additional actuators may be placed between actuators 60 and 62 in order to deform beam 14 and more closely regulate the shape of gap 15 along the length of roll 12. In an alternative embodiment (not shown), actuators 60 and 62 could be used to adjust gap 15 by moving roll 12 (instead of beam 14) while beam 14 remains stationary (instead of roll 12).

Other types of sensors 50 and 52 may be used. For example, sensors 50 and 52 which implement a beta gauge, a capacitive gauge, or a physical measurement of the combined web and coating thickness, can be substituted for the optical density sensors described above. The size of gap 15 may also be measured directly by optical or capacitive displacement devices or other similar means known to those skilled in the art. Alternative control methods may require that the angular position of roll 12 and other rolls (if any) be monitored.

Figure 4:
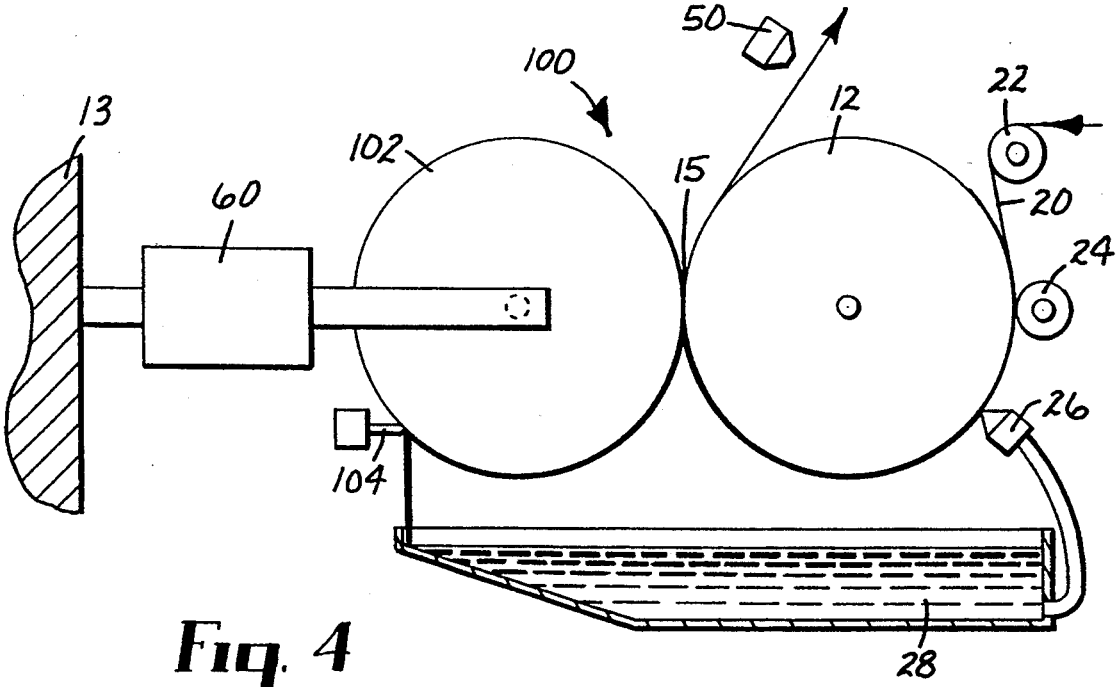
FIG. 4 is a side view of a double roll gap coating device in accordance with the present invention.

Another embodiment of the present invention is shown as double roll gap coating device 100 in FIG. 4. Where components in double roll gap coating device 100 are identical to those in single roll gap coating device 10, the same reference numerals are used in each figure. In FIG. 4, metering roll 102 replaces metering beam 14. Metering roll 102 is driven in the same direction, clockwise, as back-up roll 12, though not necessarily at the same speed. As with the single roll gap coating device 10 shown in FIG. 1, web 20 follows a path around roll 12 and is covered with a coating of fluid by flow bar 26. When the portion of web 20 covered with coating fluid reaches gap 15 between the two rolls 102 and 12, the excess coating fluid is removed from web 20 and adheres to the surface of metering roll 102. Web 20 emerges from gap 15 with the desired coating thickness. The excess coating fluid on metering roll 102 is removed with doctor blade 104, and returned to coating fluid reservoir 28, from where it may be recirculated to flow-bar 26 to begin another cycle. Additional fluid may be added to reservoir 28 as needed.

The gap 15 between the metering roll 102 and the back-up roll 12 may be adjusted by employing the sensors (e.g., 50, 52) and actuators (e.g., 60, 62) described above with regard to the single roll gap coating device 10. However, it should be noted that for the double roll device 100, the sensor signals being conveyed to the automatic controller 54 would reflect the combined run-out of rolls 12 and 102. These two rolls 12 and 102 may be of differing radii and may be rotating at different radial frequencies. A multivariable version of the algorithms described above could be used to allow the automatic controller 54 to provide adjusting signals to compensate for the combined runout of the two rolls 12 and 102, in which case the phase differences between the runouts of the individual rolls may be part of the total runout compensation.

In another embodiment (not shown), roll 12 may be replaced by a beam. While such a device would not be subject to periodic variations in coating thickness due to periodic roll runout, it would nevertheless have to compensate for periodic variations in web caliper, fluid viscosity, and excess fluid applied by flow bar 26.

In another embodiment (not shown), flow bar 26 may be replaced by a coating fluid applying roll. The fluid applying roll would be located adjacent to roll 12 and would have an axis of rotation parallel to the axis of rotation of roll 12. Any runout from the fluid applying roll may periodically affect the thickness of the coating applied to web 20. Thus, in the case of the double roll gap coating device, the automatic controller 54 would have to compensate for the combined runout of the applying roll, roll 12 and roll 102. Automatic controller 54 can use the same algorithms discussed above to compensate for this three-way combined runout.

Although the present invention has been described with reference to the preferred embodiments, workers skilled in the art will recognize that changes may be made in form and detail without departing from the spirit and scope of the invention. For example, the invention could be used in a coater using a roll having a resilient covering where a negative interference gap is desired. The gap controller may also be used with other manual and automatic gap control systems to allow them to compensate for periodic variations in coating thickness.

While the preceding examples describe the coating of a web with a fluid, those skilled in the art will recognize that the gap controller described here will be useful where the fluid is applied directly to a roll's surface and then caused to solidify, gel, or coagulate to form a web that may be stripped from the roll to form a self-supporting web. Thus the present invention may be used to regulate the thickness of numerous materials, such as a cast or extruded web.

What is claimed is:

1. A method of regulating the thickness of a coating applied to a web to minimize repeating variations in coating thickness, including the steps of:

applying a coating to a web;

passing the coated web through a gap defined between a beam and a roll rotatably mounted about an axis substantially parallel to the beam;

sensing the thickness of the coating on the web at a position downweb from the gap and generating information representative of the coating thickness;

analyzing the information to detect the presence of repeating variations in the thickness of the coating on the web and adjusting for a difference in phase of the repeating variations of the coating thickness at the sensor and its phase at the gap;

converting the information into gap adjusting signals, whereby the signals correspond to the thickness of the coating on the web at the gap and not the thickness of the coating at the sensor; and adjusting the size of the gap to compensate for the repeating variations in coating thickness.

2. The method of claim 1, wherein the step of adjusting the size of the gap comprises the use of one of a piezoelectric and magnetostrictive actuator.

3. The method of claim 1, wherein the repeating variations consist essentially of runout.

4. The method of claim 1, wherein the outer surface of the roll is made of a resilient material and the gap is a negative gap, wherein the resilient material is deformed by the beam to form the negative gap.

5. The method of claim 1, wherein the step of analyzing the information comprises using one of a single and multi-variable closed-loop control function.

6. The method of claim 1, wherein the step of analyzing the information comprises using a proportional integral differential (PID) control function.

7. The method of claim 1, wherein the step of analyzing the information comprises using an autoregressive integrated moving average (ARIMA) transfer function.

8. The method of regulating the thickness of a web during formation of the web to minimize repeating variations in web thickness, including the steps of:

passing a material through a gap to form the material into a web, the gap being defined between a beam and a roll rotatably mounted about an axis substantially parallel to the beam;

sensing the thickness of the web at a position downweb from the gap and generating information representative of the web thickness;

analyzing the information to detect the presence of repeating variations in the thickness of the web and adjusting for a difference in phase of the repeating variations of the web thickness at the sensor and its phase at the gap;

converting the information into gap adjusting signals, whereby the signals correspond to the thickness of the web at the gap and not the web thickness at the sensor; and adjusting the size of the gap to compensate for the repeating variations in web thickness.

9. The method of claim 8, wherein the step of adjusting the size of the gap comprises the use of one of a piezoelectric and magnetostrictive actuator.

10. The method of claim 8, wherein the repeating variations consist essentially of runout.

11. The method of claim 8, wherein the outer surface of the roll is made of a resilient material and the gap is a negative gap, wherein the resilient material is deformed by the beam to form the negative gap.

12. The method of claim 8, wherein the step of analyzing the information comprises using one of a single and multi-variable closed-loop control function.

13. The method of claim 8, wherein the step of analyzing the information comprises using a proportional integral differential (PID) control function.

14. The method of claim 8, wherein the step of analyzing the information comprises using an autoregressive integrated moving average (ARIMA) transfer function.

* * * * *